US010689971B2

(12) United States Patent
Smith et al.

(10) Patent No.: US 10,689,971 B2
(45) Date of Patent: Jun. 23, 2020

(54) BRIDGE PLUG SENSOR FOR BOTTOM-HOLE MEASUREMENTS

(71) Applicant: Halliburton Energy Services, Inc., Houston, TX (US)

(72) Inventors: Kenneth James Smith, Houston, TX (US); Norman R. Warpinski, Cypress, TX (US); Mikko Jaaskelainen, Katy, TX (US); Brian Vandellyn Park, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 153 days.

(21) Appl. No.: 15/775,794

(22) PCT Filed: Dec. 16, 2015

(86) PCT No.: PCT/US2015/066073
§ 371 (c)(1),
(2) Date: May 11, 2018

(87) PCT Pub. No.: WO2017/105433
PCT Pub. Date: Jun. 22, 2017

(65) Prior Publication Data

US 2018/0320503 A1 Nov. 8, 2018

(51) Int. Cl.
*E21B 47/12* (2012.01)
*E21B 33/12* (2006.01)
(Continued)

(52) U.S. Cl.
CPC ..... *E21B 47/06* (2013.01); *E21B 33/12* (2013.01); *E21B 33/134* (2013.01);
(Continued)

(58) Field of Classification Search
CPC ..... E21B 33/12; E21B 33/134; E21B 47/12
See application file for complete search history.

(56) References Cited

U.S. PATENT DOCUMENTS 4,035,763 A 7/1977 Cowles
8,505,625 B2 * 8/2013 Ravi ..... E21B 33/14 166/250.14

(Continued)

FOREIGN PATENT DOCUMENTS

WO 2013134201 9/2013
WO 2015020642 2/2015

OTHER PUBLICATIONS

Molenaar et al., SPE 140561 MS: "First Downhole Application of Distributed Acoustic Sensing (DAS) for Hydraulic Fracturing Monitoring and Diagnostics," SPE International, SPE Hydraulic Fracturing Technology Conferenve and Exhibition, Jan. 2011: pp. 1-9.

(Continued)

*Primary Examiner* — Kenneth L Thompson
(74) *Attorney, Agent, or Firm* — Chamberlain Hrdlicka

(57) ABSTRACT

Example apparatus, methods, and systems are described for performing bottom hole measurements in a downhole environment. In an example system, a bridge plug is deployed at a downhole location of a cased well, An optical fiber cable is deployed exterior to the casing of the well. The bridge plug includes a sensor and an acoustic signal generator, which transmits acoustic signals through the casing to the optical fiber cable.

19 Claims, 4 Drawing Sheets

(51) Int. Cl.

| | |
|---|---|
| ***E21B 33/134*** | (2006.01) |
| ***E21B 47/06*** | (2012.01) |
| *E21B 43/14* | (2006.01) |
| *E21B 43/26* | (2006.01) |

(52) U.S. Cl.
CPC ..... *E21B 47/123* (2013.01); *E21B 43/14* (2013.01); *E21B 43/26* (2013.01)

(56) References Cited

U.S. PATENT DOCUMENTS

| | | | | |
|---|---|---|---|---|
| 8,902,078 | B2 * | 12/2014 | Vick, Jr. ..... | E21B 47/14 340/854.3 |
| 9,759,037 | B2 * | 9/2017 | Shampine ..... | E21B 33/134 |
| 2002/0157828 | A1 | 10/2002 | King et al. | |
| 2004/0173363 | A1 | 9/2004 | Navarro-Sorroche | |
| 2006/0016593 | A1 | 1/2006 | Gambier | |
| 2014/0191120 | A1 | 7/2014 | Donderici et al. | |
| 2017/0138187 | A1 * | 5/2017 | Moronkeji ..... | E21B 47/123 |
| 2017/0268320 | A1 * | 9/2017 | Angman ..... | E21B 43/26 |
| 2018/0112486 | A1 * | 4/2018 | Potts ..... | E21B 23/14 |

OTHER PUBLICATIONS

Molenaar et al., SPE 140561 PA: "First Downhole Application of Distributed Acoustic Sensing (DAS) for Hydraulic-Fracturing Monitoring and Diagnostics," SPE Drilling & Completion, Mar. 2012: pp. 32-38.

International Search Report and Written Opinion of PCT Application No. PCT/US2015/066073 dated Sep. 6, 2015: pp. 1-16.

Engel, SPE 662: "Remote Reading Bottom-Hole Pressure Guages—An Evaluation of Installation Techniques and Practical Applications," Journal of Petroleum Technology, Dec. 1963: pp. 1303-1313.

* cited by examiner

BRIDGE PLUG SENSOR FOR BOTTOM-HOLE MEASUREMENTS

BACKGROUND

In drilling and completion of subterranean wells, such as oil and gas wells, it is often important to monitor the physical conditions inside the borehole of an oil well, in order to ensure proper operations of the well. However, it can be difficult for operators to perform accurate bottom hole measurements. For example, bottom hole pressure data calculated from surface pressure is inaccurate for applications other than gross behavior (e.g., screen out, ball seats, etc.).

The instrumentation of wells using fiber optics-based distributed systems such as distributed temperature sensing (DTS), distributed acoustic sensing (DAS), and other sensing systems based on for example interferometric sensing is well established. Optical fiber can be run on the outside of tubing to the surface, where interrogators detect reflected light from the entire length of the fiber and/or single/multi point sensors. However, in some cases there are structures in the well which prevent, or make difficult, fiber from being installed over the entire length of the string, or at least overall regions of interest. For example, during multi-zone fracturing operations, packers and/or bridge plugs will be used in a cased well to isolate zones for separate perforating and/or fracturing, and will often include sequential isolation of multiple zones within the well has the perforating and fracturing is performed. These packers and bridge plugs preclude passage of a fiber through the interior of the casing. As a result, downhole measurements are difficult during such hydraulic fracturing and the following initial shut-in periods, as it is not feasible to provide physical communication with downhole sensors, such as through wireline, fiber-optic cable, coiled tubing, etc. within the casing.

DETAILED DESCRIPTION

Figure 1:
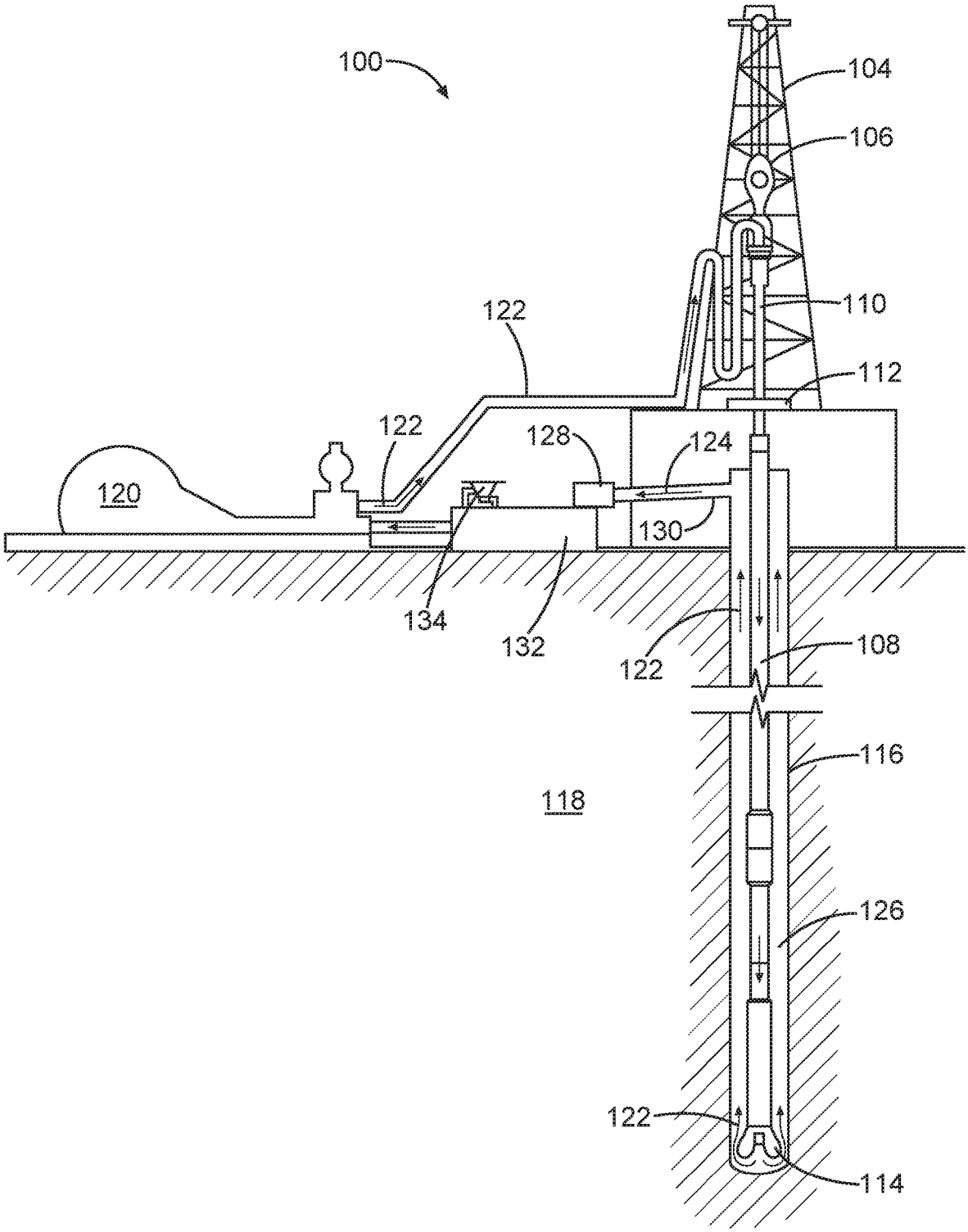
FIG. 1 is a schematic view of a wellbore drilling assembly, according to one or more embodiments.

To address some of the challenges described above, as well as others, systems, methods, and apparatus are described herein that operate to perform bottom hole measurements, and to convey such measurements to the surface notwithstanding structures in place obstructing the interior of the casing.

In drilling and completion of subterranean wells, such as oil and gas wells, it is often desirable to isolate particular zones within the well by placing or forming a seal within the well bore or well casing. This can be accomplished by temporarily plugging off the well casing at a given point with a bridge plug. In some operations, such as multi-stage fracturing operations multiple bridge plugs may be set at spaced depths to sequentially isolate a multiple of separate zones being separately perforated and/or fractured. The purpose of the plug is to isolate one portion of the well from another portion of the well. Bridge plugs are particularly useful in accomplishing operations such as isolating perforations in one portion of a well from perforations in another portion, or for isolating the bottom of a well from a wellhead. Such bridge plugs may often be made of drillable components so that they can be drilled from the well after use.

Bridge plugs can be deployed to seal off portions of wells in preparation for perforating operations. Perforations can then be created at zones of interest by generating holes in the walls of the casing and surrounding formations. Fluid can then be injected into the well and into a formation that intersects the well to treat the formation. Once fluid pressure is released, fluid from the formation above the bridge plug may flow upwardly in the well. The bridge plug will prevent any fluid in the well below the bridge plug from passing upwardly there through. It is often desirable to conduct bottomhole measurements during and after such fracturing operations, particularly pressure measurements, to monitor conditions of the well and inferentially of the fracturing operation.

In example embodiments as described herein, one or more sensors are provided in a bridge plug that communicates with a fiber optic cable implementing a distributed acoustic sensing (DAS) system. In some embodiments, a pressure gauge is provided in the bridge plugs that are run downhole after each planned stage of a well. Each pressure gauge will face the next stage such that it can record bottom hole pressure during pumping or fracturing operations. Pressure measurements are conveyed using acoustic signals to a deployed fiber optic cable external to the casing, using frequency bands to transmit digital information or frequency modulation to transmit analog information. Having a pressure sensor in each bridge plug allows for observation of each stage during fracturing and shut-in, to assist in determining, among other conditions, any issues with isolation between zones. Time of flight in a time domain based fiber optic sensing system will allow spatial separation between measurements from different sensors. In this way, multiple stages can be monitored in real time.

With reference to FIG. 1, the systems and apparatus for bottom hole measurements described herein may directly or indirectly affect one or more components or pieces of equipment associated with a wellbore drilling assembly 100, according to one or more embodiments. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a wellbore 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (e.g., a mud pit). While illustrated as being arranged at the outlet of the wellbore 116 via the annulus 126, those skilled in the art will readily appreciate that the fluid processing unit(s) 128 may be arranged at any other location in the drilling assembly 100 to facilitate its proper function, without departing from the scope of the disclosure.

A mixing hopper 134 is communicably coupled to or otherwise in fluid communication with the retention pit 132. The mixing hopper 134 may include, but is not limited to, mixers and related mixing equipment known to those skilled in the art. In at least one embodiment, for example, there could be more than one retention pit 132, such as multiple retention pits 132 in series. Moreover, the retention pit 132 may be representative of one or more fluid storage facilities and/or units where the sealant composition may be stored, reconditioned, and/or regulated until added to a drilling fluid 122.

Various embodiments provide systems and apparatus configured for delivering the bridge plugs described herein to a downhole location after drilling and for conducting bottom hole measurements.

Figure 2:
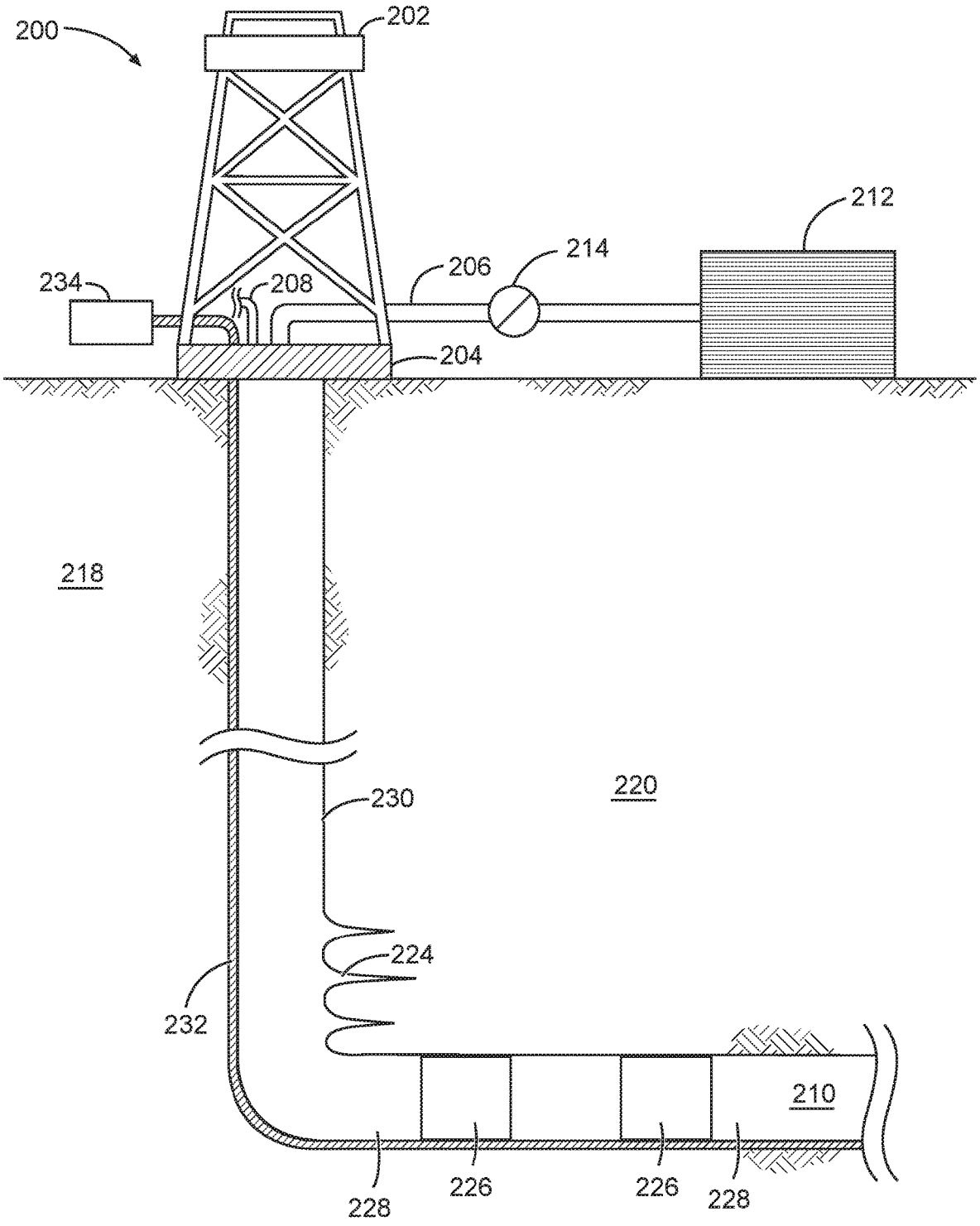
FIG. 2 is a schematic view of an example oilfield system, according to one or more embodiments.

FIG. 2 illustrates an example oilfield system 200 accommodating a well with a bridge plug, according to one or more embodiments. It should be noted that while FIG. 2 generally depicts a land-based system, it is to be recognized that like systems can be operated in subsea locations as well. Embodiments of the present invention can have a different scale than that depicted in FIG. 2. A rig 202 is provided at the oilfield surface over a wellhead 204 with various lines 206, 208 coupled thereto for hydraulic access to a well 210. More specifically, a high pressure line 206 is depicted along with a production line 208. The high pressure line 206 is coupled to a mixing tank 212, in which fluid compositions can be formulated before introduction into the well 210. Pump 214 is configured to raise the pressure of fluid compositions to a desired degree before its introduction into the well 210. For example, the pump 214 generates at least about 5,000 psi in fracturing applications. The well 210 is defined by casing 230, and although not specifically depicted, the casing can be cemented in place to define a cemented well casing.

The embodiments described below make use of electro acoustic technology ("EAT") sensors and sensing technology. The EAT sensors and EAT sensing technology described in this disclosure is a recently developed technology and has been described in a recently published PCT application: WO2015020642A1.

EAT sensors represent a new approach to fiber optic sensing in which any number of downhole sensors, electronic or fiber optic based, can be utilized to make the basic parameter measurements, but all of the resulting information is converted at the measurement location into perturbations or a strain applied to an optical fiber cable that is connected to an interrogator that may be located at the surface of a downhole well. The interrogator may routinely fire optical signal pulses downhole into the optical fiber cable. As the pulses travel down the optical fiber cable back scattered light is generated and is received by the interrogator.

The perturbations or strains introduced to the optical fiber cable at the location of the various EAT sensors can alter the back propagation of light and those effected light propagations can then provide data with respect to the signal that generated the perturbations.

The depicted example EAT system includes surface components to send signals induced into an optical fiber cable by a downhole sensor system, as will be described below. An EAT receiver 234 or "interrogator" at the surface is coupled to an optical fiber cable 232 which extends, in this described configuration, exterior to the casing within the wellbore, as addressed in more detail below. Light signals propagating in the optical fiber cable will be analyzed to extract the signal from the optical fiber. In one embodiment, a interrogator unit is used to extract the signal from the optical fiber. The optical fiber cable will, in many embodiments, be part of a DAS fiber system where coherent Rayleigh scattering is used to detect the acoustic signal; or may be may be implemented through other forms of interferometer based on, for example, Michelson, Mach-Zehnder, Fabry-Perot principles etc.

The interrogator can be structured, for example, to inject a laser pulse into the optical fiber. As the pulse travels down the optical fiber, Rayleigh back scattered light is generated by impurities within the silica lattice structure of the optical fiber. The backscattered light from the pulses will interfere with each other, generating a signal amplitude that is dependent on the amount of strain on the optical fiber. It is noted that the strain on the optical fiber cable 312 depends on the perturbation of the optical fiber by the transducer. The signal is effectively a representation of the instantaneous strain on the optical fiber, which can be generated by acoustic signals (vibrational impulses) acting upon the fiber.

In a system implemented to use Rayleigh scattering, the Rayleigh back-scattered light is collected at the surface using the interrogator unit 234 and recombined with the input signal to determine an amplitude and phase associated with the depth from which the signal came. In this way, a value of the measured pressure is extracted by receiving the optical signal resulting from the perturbation of the fiber. In the course of fracturing operations, fracturing fluids, primarily composed of water, as well as other additives, including gelling agents, breakers, proppant, and other fluid treatment agents, can be pumped downhole for stimulating hydrocarbon production from subterranean formations 218. Generally, the fluids are conveyed via high pressure line 206 to wellhead 204, where the fluid composition enters the well 210. Fluid compositions subsequently penetrate into subterranean formation 218. The production line 208 is provided for recovery of hydrocarbons following completion of the well 210. However, the production line 208 can also be utilized in recovering fracturing fluids, such as that pumped downhole via high pressure line 206. In some embodiments, at least a portion of the fracturing fluids flow back to wellhead 204 and exit subterranean formation 218. The fracturing fluids that have flowed back to wellhead 204 can subsequently be recovered (e.g., via production line 208), and in some examples reformulated, and recirculated back to subterranean formation 218.

In the example of FIG. 2, the well 210 is shown traversing subterranean formation 218 (e.g., potentially traversing various formation layers and thousands of feet) before reaching a production region 220. High pressure fracturing applications can be applied through well casing 230 and directed at production region 220. Perforations 224 penetrating the production region 220 are formed by conventional fracturing applications. Bridge plugs 226 are employed for isolating stages (e.g., lateral leg portions 228) of the well 210. In some embodiments, the bridge plugs 226 are dropped by wireline down a vertical portion of the well 210. Upon reaching the lateral portion of the well 210, hydraulic pressure is employed to push bridge plugs 226 into position before wireline actuating the bridge plugs 226 for setting the plugs. In other embodiments, slickline, jointed pipe, or coiled tubing can be used to deploy bridge plugs. In such embodiments, bridge plug setting can be hydraulically actuated or through the use of a separate setting tool.

When deployed, bridge plugs 226 isolate more downhole sections (e.g., sometimes encased portions) of the lateral portion of the well 210. For example, with bridge plugs 226 deployed as illustrated in FIG. 2, fracturing operations can be focused at the area of the well 210 uphole of the bridge plug 226. Thus, localization of high pressure pumping of the fracturing fluids into the perforations 224 at the production region 220 can be achieved. As noted above, subsequent recovery of fracturing fluids (or hydrocarbons from production) is achieved through production line 208, once one or more bridge plugs are removed from the well.

It is to be recognized that system 200 is merely exemplary in nature and various additional components can be present that have not necessarily been depicted in FIG. 2 in the interest of clarity. Non-limiting additional components that can be present include, but are not limited to, supply hoppers, valves, condensers, adapters, joints, gauges, sensors, compressors, pressure controllers, pressure sensors, flow rate controllers, flow rate sensors, temperature sensors, and the like. Such components can also include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the systems and apparatuses generally described above and depicted in FIGS. 1-2.

Figure 3:
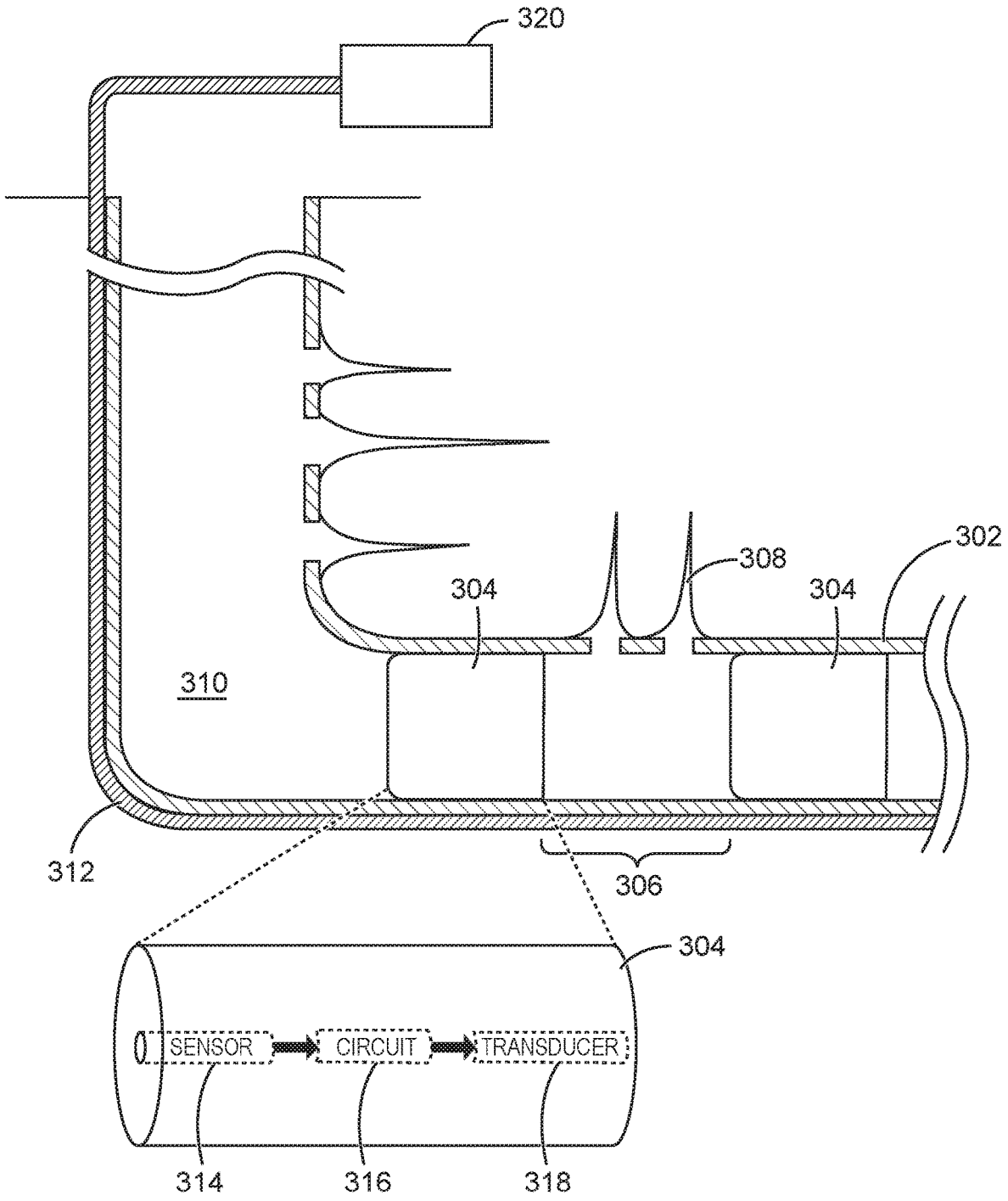
FIG. 3 is an enlarged view of a downhole portion of a well, according to one or more embodiments.

FIG. 3 illustrates an enlarged view of a downhole portion of a well, according to one or more embodiments. The well 310 (e.g., enlarged illustration of well 210 from FIG. 2) is defined by casing 302 which extends into both more uphole and downhole portions of the well 310. Tubulars (such as, coiled tubing or production tubing string) can be positioned in the casing 302. In some embodiments, the bridge plug 304 is positioned within casing 302 using methods that can require a significant force or impulse, such as an explosive charge, to couple the bridge plug 304 within the well casing 302. In other embodiments, setting of the bridge plug 304 can be actuated hydraulically or through the use of a separate setting tool which radially expands the bridge plug into position. Slips (not shown) may be provided on the bridge plug 304 to assist in holding the bridge plug 304 in place within the wellbore or casing 302. For example, teeth in the slips component of the bridge plug 304 can be actuated to dig into the casing 302, thereby anchoring the bridge plug 304 in place. The slips help keep the bridge plug 304 immobilized in spite of differential pressure potentially exceeding 5,000 psi during perforating or fracturing applications.

The bridge plug 304 can be either drillable or retrievable. Drillable bridge plugs are typically constructed of a brittle metal that can be drilled out, such as iron. An alternative to drillable bridge plugs are various configurations of retrievable bridge plugs, which can be used to temporarily isolate portions of the well 310 before being removed, intact, from the well interior. Retrievable bridge plugs typically have anchor and sealing elements (not shown) that engage and secure it to the interior wall of the casing 302. To retrieve the bridge plug 304, a retrieving tool (not shown) is lowered into the casing 302 to engage a retrieving latch, which, through a retrieving mechanism, retracts the anchor and sealing elements, allowing the bridge plug 304 to be pulled out of the wellbore.

Completion and stimulation for horizontal wells, for example, often includes dividing the horizontal wellbore length into a number of planned intervals, or stages 306, designated for fracture treatment. To promote fracture growth from multiple starting points, stages are typically designed with two to eight perforation clusters 308 distributed uniformly along the stage length.

One example completion technique, plug and perforation completion, is a flexible multi-stage well completion technique for cased hole wells where each stage can be perforated and treated independently. Knowledge from each previous stage can be applied to optimize treatment of the current stage. When performing multi-stage treatments, a bridge plug 304 is positioned after each stage 306 to isolate the previous stage. Perforation guns are fired to create perforation clusters 308 before fracturing operations are performed. After each stage is completed, the next plug is set, and perforations are initiated, and the process is repeated moving further uphole (e.g., up the well).

The well 310 includes an optical fiber cable 312 positioned along the exterior of well casing 302. The optical fiber cable 312 is usually run outside the well casing 302 and clamped before being cemented into position. It is important not to perforate fibers when creating perforation clusters 308; the clamps (not shown) holding the optical fiber cable 312 in place usually have a certain amount of metal mass that can be detected using electro-magnetic means or a current detector to prevent accidental perforation of the optical cable 312. The optical fiber cable 312 can include any combination of lines (e.g., optical, electrical, and hydraulic lines) and reinforcements. Multiple fibers within one optical fiber cable 312 can offer redundancy and/or the ability to interrogate with different instrumentation simultaneously.

The optical fiber cable 312 is primarily sensitive along its axis, making it analogous to a single continuous component geophone oriented along the wellbore (which itself could be deviated and changing orientation) that allows for the recording of acoustic records. At low frequencies, the optical fiber cable 312 can be sensitive to temperature variation as well as acoustic sources.

The bridge plug 304 includes one or more sensors (e.g., a sensor 314) that are operable to provide a measurement relating to wellbore conditions within stage 306 during various stages of well construction and/or operation. The sensor 314 can be realized in a number of different ways depending on a parameter of interest to be monitored. The parameter of interest can include, but is not limited to, pressure, strain, resistivity, chemical composition, chemical concentration, flow rate, or temperature.

In one embodiment, the sensor 314 is a pressure gauge for measuring pressure within the well, such as during fracturing operations. The pressure gauge faces the next stage (e.g., in an uphole direction) so that it can record bottom-hole pressure during pumping and also during the shut in period after the next plug has been set. The pressure gauge may be of any suitable configuration of electronic or mechanical construction responsive to pressure surrounding the gauge. As one specific example, in some embodiments the pressure gauge might include a physically movable or deformable sensing element, such as a diaphragm, directly coupled to processing circuitry 316, or to other sensing circuitry.

Processing circuitry 316 can be connected to sensor 314 in the bridge plug 304 to receive the measured parameter (e.g., bottom hole pressure) and generate a parameter signal correlated to the parameter. The processing circuitry may be configured to operate in either the analog or the digital domain, depending upon the characteristics of sensor 314 and the output which it provides. A portion of the processing circuitry for generating a parameter signal from the sensor (in the present example, a pressure gauge) may include, for example, an analog to digital converter, as well as various pulse limiting, pulse shaping, filtering, or amplification circuits, as well as other individual circuits. Such structures may be configured to remove any undesired portions of the sensor signal, and to condition the signal for communication as an acoustic signal. In some cases, the processing circuitry 316 may receive an analog signal from the sensor 314, and process the signal entirely in the analog domain. The processing circuitry 316 will preferably include or be connected to a transducer 318 (which may be any of various forms), to create an acoustic signal sufficient to perturb optical fiber cable 312. An "acoustic signal" as utilized herein is any vibrational signal (which may also be considered as a varying compressional signal), whether humanly audible or not, which may be detected to result in communication of the signal (and/or any data represented by the signal) from one location to another. The transducer can be integrated with the processing circuitry 316, integrated with the sensor 314, or can represent a separate structure coupled to the processing circuitry 316. In some embodiments, the parameter signal can be a "compensated signal," having a characteristic that corresponds to the parameter of interest for which variations in one or more other parameters are corrected or removed, or for which the characteristic is isolated to the parameter of interest.

The transducer 318 is an acoustic signal generator positioned in proximity to the casing to communicate an acoustic signal through the casing to optical fiber cable 312. Because optical fiber 312 extends along the exterior of the casing to one or more regions of interest, and is coupled to the casing (which is cemented in place within the borehole) the optical fiber is well-coupled to the casing such that acoustic signals from the transducer 318 can traverse the casing and result in perturbations to optical signals within the optical fiber cable 312. For example, such a transducer 318 can be constructed as a vibrator, or other oscillating device. In this way, the vibrations of the acoustic signal can be transferred from the transducer 318 through the casing 302, and possibly a portion of the cement sheath (and any other intervening elements) to the optical fiber cable 312. In some embodiments, the transducer can be a voice coil actuator that generates signals at one or more frequencies sufficient to communicate through the casing (etc.) to the optical fiber to induce a strain into the optical fiber cable 312.

It is noted that the bridge plug 304 is not limited to a single transducer. It can be desirable to have multiple transducers in bridge plug 304 For example, a different transducer can be positioned in bridge plug 304 for each of the one or more sensors 314 included in the bridge plug 304. Generally, each of these different transducers will operate at a different frequency from each other. Alternatively, multiple transducers might be used for a single sensed parameter to communicate signals at different times and/or frequencies and/or with one or more modulation schemes to facilitate redundancy of communications and/or error detection and/or correction capability.

The perturbations in the optical fiber cable 312 alter the physical characteristics of the fiber to affect propagation of light. Disturbances in the light propagating through the optical fiber cable 312 can be due to acoustic signals, wherein the acoustic signals can change the index of refraction of the optical fiber cable 312 or mechanically deform the optical fiber cable 312 such that Rayleigh backscatter property of the optical fiber cable 312 changes.

The effects on the light propagation are related to the parameter signal used to generate the perturbation. Thus, an analysis of the effects on light propagation can provide data regarding the parameter signal that generated the perturbation and the measured parameter of interest. In other words, an acoustic signal representative of a parameter of interest (e.g., pressure in the wellbore) is provided to the optical fiber cable 312. The acoustic signal traverses any casing, cement, and any additional intervening elements positioned between the bridge plug 304 and the optical fiber 312. In this way, a light signal carried by the optical fiber cable 312 is modulated.

Light signals propagating in the optical fiber cable 312 can be analyzed to extract the parameter signal from the optical fiber cable 312. In one embodiment, an interrogator unit 320 is used to extract the parameter signal from the optical fiber cable 312. The interrogator unit 320 is positioned uphole from the bridge plug 304 (e.g., at the surface) that is configured to interrogate the optical fiber cable 312 and receive an optical signal including the effects of the perturbation. In an example, the received signal is a back scattered optical signal.

The interrogator unit 320 can be structured, for example, to inject a laser pulse into the optical fiber cable 312. As the pulse travels down the optical fiber cable 312, Rayleigh back scattered light is generated by impurities within the silica lattice structure of the optical fiber cable 312. The backscattered light from the pulses will interfere with each other, generating a signal amplitude and/or phase change that is dependent on the amount of strain on the optical fiber cable 312 at the location where the back scattered light originates. It is noted that the strain on the optical fiber cable 312 depends on the perturbation of the optical fiber cable 312 by the transducer. The signal is effectively a representation of the instantaneous strain on the optical fiber cable 312, which can be generated by sound (e.g., pressure waves and shear waves) and, at low frequencies, changes in temperature.

Rayleigh back-scattered light is collected back at the surface using the interrogator unit 320 and recombined with the input signal to determine an amplitude and phase associated with the depth from which the signal came. In this way, a value of the measured parameter of interest is extracted by receiving the optical signal from the perturbation. Thus, the optical fiber cable 312 can be segregated into many acoustic channels of a chosen length along the whole length of the fiber, limited by the speed of the switch generating the laser pulse. The resulting signal can have a bandwidth of 20 kHz on a 4 km-long fiber (although it can be much higher on shorter fibers) with channel lengths ranging from 1-10 m. It is further noted that since the frequency range of the signal is known, a filter can be included, such as at the surface, as a portion of the interrogator, to enhance the signal to noise ratio (SNR) of the received signal.

Figure 4:
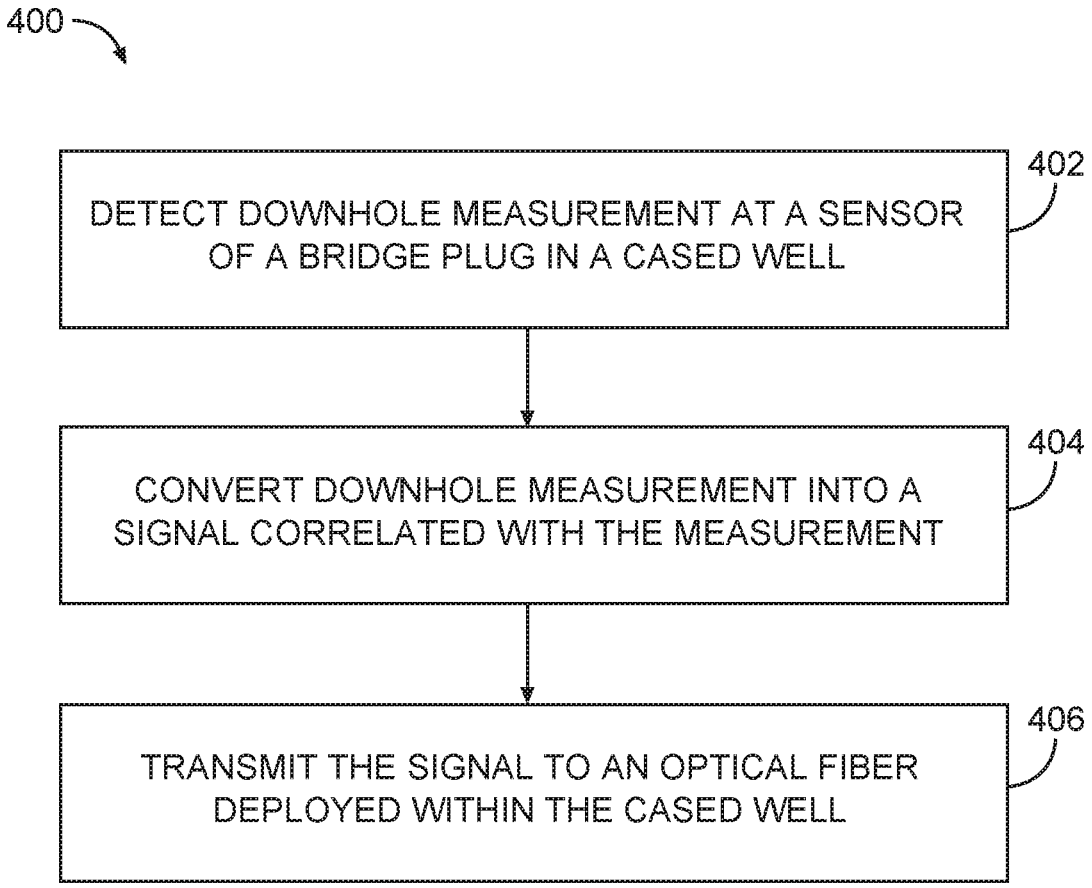
FIG. 4 is a flow diagram illustrating an example method for conducting bottom hole measurements, according to one or more embodiments.

FIG. 4 is a flow diagram illustrating an example method 400 for conducting bottom hole measurements, according to one or more embodiments. The method 400 beings at operation 402 by detecting a measurement at a sensor of a bridge plug deployed at a downhole location of a cased well. The sensor can be realized in a number of different ways depending on a parameter of interest to be determined by the measurement using the sensor. The parameter of interest can include, but is not limited to, pressure, strain, resistivity, chemical composition, chemical concentration, flow rate, or temperature.

In one embodiment, the sensor s a pressure gauge positioned to face an uphole direction for measuring pressure within the cased well, such as during fracturing operations. The pressure gauge faces the next stage (e.g., uphole direction) so that it can record bottom-hole pressure during pumping and also during the shut in period after the next plug has been set. The pressure gauge can be of any suitable structure, such as the structures previously described relative to sensor 314 in FIG. 3.

At operation 404, the measurement is converted into a signal correlated with the measurement. Processing circuitry can be connected to the bridge plug and sensor to receive the measured parameter (e.g., bottom hole pressure) and generate a parameter signal correlated to the parameter. For example, an analog-to-digital converter can be used to generate an acoustic signal correlated with the measurement. The processing circuitry may include different individual circuits of the types described in reference to processing circuitry 316 of FIG. 3; in combination with one or more transducers as also described in reference to FIG. 3.

At operation 406, the signal is transmitted to an optical fiber coupled to the exterior of the casing. For example, such a transducer can be constructed as a vibrator or other oscillating mechanism to generate an acoustic signal that can communicate through the casing (and possibly the cement and/or any additional intervening structures), to transfer the acoustic signal from the transducer to the optical fiber.

Perturbations induced in the optical fiber cable by the transducer alters the physical characteristics of the optical fiber therein and affects the propagation of light through the fiber (i.e., modulating the propagation of light through the fiber). The modulation of the light propagation is a function of the signal used to generate the perturbation and thus communicates the data represented by the acoustic signal to the interrogator (234 in FIG. 2).

As previously noted, the interrogator can launch optical pulses into the optical fiber. As the pulses travel down the optical fiber, back scattered light is generated and is received by the interrogator. The interrogator can analyze this back-scattered light as a function of time and is able to calculate temperature, strain, or acoustic signal effects as a function of distance along the fiber. Time of flight analysis can allow spatial separation between measurements from different sensors. Thus, the location along the optical fiber cable at which a measurement is made and its representative signal is transduced onto the optical fiber cable can be determined from time of flight analysis.

In one embodiment, bridge plug failures can be identified by monitoring the location of responses along the optical fiber cable using, for example, time of flight analysis. Measurement data from a sensor of a bridge plug is generally transmitted to the optical fiber cable at the particular location where the bridge plug is deployed. Bridge plug failures, such as the bridge plug becoming dislodged and pushed downhole, can be identified based on changes in the downhole location at which the acoustic signal is transmitted to the optical fiber sensor.

Many advantages can be gained by implementing the apparatus, methods, and systems described herein. For example, in some embodiments, using the bridge plug as a carrier for a pressure sensor allows for observation of the fracturing and shut in of each stage. Further, multiple stages can be monitored at the same time, allowing for identification of any occurrences of isolation issues. The bottom hole measurements described herein allow operators to better analyze, control, and automate fracturing.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The following numbered examples are illustrative embodiments in accordance with various aspects of the present disclosure.

1. The system for use in casing cemented in a wellbore of a well may include a bridge plug deployed at a downhole location in the casing, wherein the bridge plug includes a sensor and an acoustic signal generator, and an optical fiber sensing system coupled to the exterior of the casing to detect acoustic signals from the acoustic signal generator.
2. The system of example 1, in which the sensor is a pressure sensor oriented to detect pressures experienced uphole of the bridge plug.
3. The system of any of the preceding examples, further including an independent power source to power the sensor.
4. The system of any of the preceding examples, in which the acoustic signal generator is at a distance from the optical fiber sensing system.
5. The system of any of the preceding examples, in which the optical fiber sensing system transmits a modulated light signal from the well to a surface detector in response to the detected acoustic signals.
6. The system of any of the preceding examples, in which the bridge plug further includes a second sensor and a second signal generator.
7. The system of any of the preceding examples, in which the acoustic signal generator is operable to generate a perturbation to the optical fiber sensing system based on a measurement from the sensor.
8. A method includes detecting a pressure measurement at a pressure sensor of a bridge plug deployed at a downhole location of a well with casing cemented in place, converting the pressure measurement into an acoustic signal correlated with the pressure measurement, and transmitting the acoustic signal to apply acoustic pressure on an optical fiber sensor deployed external to the casing.
9. The method of example 8, further including modulating a light signal within the optical fiber sensor based on the acoustic pressure, in which the modulated light signal represents the pressure measurement.

10. The method of either of examples 8 or 9, further including transmitting the modulated light signal to a surface detector for analyses.
11. The method of any of examples 8-10, in which transmitting the acoustic signal to apply acoustic pressure further includes perturbing the optical fiber using an acoustic transducer.
12. The method of any of examples 8-11, further including extracting the acoustic signal correlated with the pressure measurement from the optical fiber using an interrogator.
13. The method of any of examples 8-12, in which extracting the parameter includes extracting a value of the pressure measurement in response to receiving an optical signal backscattered in the optical fiber.
14. The method of any of examples 8-13, further including determining, using time of flight analysis, that a bridge plug failure event has occurred based on a change in the downhole location at which the acoustic signal is transmitted to the optical fiber sensor.
15. An apparatus includes a bridge plug including a sensor and an acoustic signal generator, in which the acoustic signal generator is configured to convert a measurement from the sensor into an acoustic signal and apply acoustic pressure for transmitting the acoustic signal.
16. The apparatus of example 15, in which the sensor includes a pressure sensor oriented to detect pressures experienced uphole of the bridge plug.
17. The apparatus of either of examples 15 or 16, further including an independent power source to power the sensor.
18. The apparatus of any of examples 15-17, in which the acoustic signal generator includes processing circuitry that is communicably coupled to a transducer.
19. The apparatus of any of examples 15-18, further including a second sensor and a second signal generator.
20. The apparatus of any of examples 15-19, in which the second sensor includes a temperature sensor.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

What is claimed is:

1. A system for use in casing cemented in a wellbore of a well, comprising:

a bridge plug deployed at a downhole location in the casing, wherein the bridge plug includes a sensor and an acoustic signal generator; and an optical fiber sensing system coupled to the exterior of the casing to detect acoustic signals from the acoustic signal generator.

2. The system of claim 1, wherein the sensor comprises a pressure sensor oriented to detect pressures experienced uphole of the bridge plug.

3. The system of claim 1, further comprising an independent power source to power the sensor.

4. The system of claim 1, wherein the acoustic signal generator is at a distance from the optical fiber sensing system.

5. The system of claim 1, wherein the optical fiber sensing system transmits a modulated light signal from the well to a surface detector in response to the detected acoustic signals.

6. The system of claim 1, wherein the bridge plug further comprises a second sensor and a second signal generator.

7. The system of claim 1, wherein the acoustic signal generator is operable to generate a perturbation to the optical fiber sensing system based on a measurement from the sensor.

8. A method, comprising:

detecting a pressure measurement at a pressure sensor of a bridge plug deployed at a downhole location of a well with casing cemented in place;

converting the pressure measurement into an acoustic signal correlated with the pressure measurement; and transmitting the acoustic signal to apply acoustic pressure on an optical fiber sensor deployed external to the casing.

9. The method of claim 8, further comprising: modulating a light signal within the optical fiber sensor based on the acoustic pressure, wherein the modulated light signal represents the pressure measurement.

10. The method of claim 8, further comprising: transmitting the modulated light signal to a surface detector for analyses.

11. The method of claim 8, wherein transmitting the acoustic signal to apply acoustic pressure further comprises perturbing the optical fiber using an acoustic transducer.

12. The method of claim 8, further comprising: extracting the acoustic signal correlated with the pressure measurement from the optical fiber using an interrogator.

13. The method of claim 12, wherein extracting the parameter includes extracting a value of the pressure measurement in response to receiving an optical signal backscattered in the optical fiber.

14. The method of claim 12, further comprising:

determining, using time of flight analysis, that a bridge plug failure event has occurred based on a change in the downhole location at which the acoustic signal is transmitted to the optical fiber sensor.

15. An apparatus, comprising:

a bridge plug including a sensor and an acoustic signal generator, wherein the acoustic signal generator is configured to convert a measurement from the sensor into an acoustic signal and apply acoustic pressure for transmitting the acoustic signal; and an independent power source to power the sensor.

16. The apparatus of claim 15, wherein the sensor comprises a pressure sensor oriented to detect pressures experienced uphole of the bridge plug.

17. The apparatus of claim 15, wherein the acoustic signal generator comprises processing circuitry that is communicably coupled to a transducer.

18. The apparatus of claim 15, further comprising a second sensor and a second signal generator.

19. The apparatus of claim 18, wherein the second sensor comprises a temperature sensor.

* * * * *